US008240160B2

(12) United States Patent
Cowans et al.

(10) Patent No.: US 8,240,160 B2
(45) Date of Patent: Aug. 14, 2012

(54) THERMAL CONTROL SYSTEM AND METHOD

(75) Inventors: Kenneth W. Cowans, Fullerton, CA (US); Matthew Antoniou, Lake Forest, CA (US); Glenn Zubillaga, Canyon Lake, CA (US); William W. Cowans, Fullerton, CA (US)

(73) Assignee: BE Aerospace, Inc., Wellington, FL (US)

( * ) Notice: Subject to any disclaimer, the term of this patent is extended or adjusted under 35 U.S.C. 154(b) by 716 days.

(21) Appl. No.: 12/410,580

(22) Filed: Mar. 25, 2009

(65) Prior Publication Data

US 2009/0248212 A1 Oct. 1, 2009

Related U.S. Application Data

(60) Provisional application No. 61/070,978, filed on Mar. 25, 2008.

(51) Int. Cl.

| | |
|---|---|
| ***F25B 41/00*** | (2006.01) |
| ***F25B 49/00*** | (2006.01) |
| ***F25B 1/00*** | (2006.01) |

(52) U.S. Cl. ..... 62/196.4; 62/222; 62/224

(58) Field of Classification Search ..... 62/196.1, 62/196.4, 197, 222, 224, 113, 513

See application file for complete search history.

(56) References Cited

U.S. PATENT DOCUMENTS

| | | | | |
|---|---|---|---|---|
| 5,634,347 | A * | 6/1997 | Hanson et al. | 62/120 |
| 6,783,080 | B2 | 8/2004 | Antoniou et al. | |
| 7,062,934 | B2 * | 6/2006 | Craps et al. | 62/259.2 |
| 7,178,353 | B2 | 2/2007 | Cowans et al. | |
| 7,415,835 | B2 | 8/2008 | Cowans et al. | |
| 2008/0319587 | A1 | 12/2008 | Cowans et al. | |

* cited by examiner

*Primary Examiner* — Marc Norman

(74) *Attorney, Agent, or Firm* — Mattingly & Malur, P.C.

(57) ABSTRACT

In a thermal control system of the type employing a two phase refrigerant that is first compressed and then is divided into a variable mass flow of refrigerant into a hot pressurized gas form and a differential remainder flow of cooled vapor derived from condensation and then thermal expansion, transitions between different temperature levels are enhanced by incremental variations of the mass flow at different control rates.

4 Claims, 2 Drawing Sheets

THERMAL CONTROL SYSTEM AND METHOD

REFERENCE TO PRIOR FIELD APPLICATIONS

This application relies for priority on previously filed provisional application 61/070,978 filed Mar. 25, 2008 by Kenneth W. Cowans et al and entitled "Thermal Control System with Advanced Temperature Capabilities".

BACKGROUND OF THE INVENTION

U.S. Pat. No. 7,178,353, issued Feb. 20, 2007 and entitled "Thermal Control System and Method", inventor Kenneth W. Cowans et al and assigned to Advanced Thermal Sciences Corporation, teaches a novel and widely applicable concept for precise and changeable temperature control of a thermal load. Among its departures from other known systems, the system circulates a two-phase refrigerant in direct thermal transfer relation to the load that is being controlled. To do this at different temperatures, it uses a controllable mix of pressurized refrigerant gas at high temperature together with a flow of the same refrigerant, after it has been condensed, then cooled by controlled expansion to provide a flow that is at least partially vapor. The mix then provides a refrigerant flow of predetermined pressure and temperature so that thermal exchange can be effected directly with the load, at a target temperature that can be adjusted up or down. This thermal control is directly effected with refrigerant alone and is therefore more efficient and responsive than most temperature control units, since both pressure and temperature can be controlled with facility, and no intermediate temperature stable media is required.

Consequently, this thermal control technique, which has been descriptively called Transfer Direct of Saturated Fluid (TDSF) is of immediate benefit in a number of demanding applications and also of potentially general capability for a wide variety of temperature control systems. It is of particular promise for applications which require precision control of thermal loads at different temperature levels, along with capability for rapidly varying the temperature levels.

When rapidly shifting between selected temperature levels, however, instabilities and offsets can be encountered since no significant time delays or averaging effects exist in the temperature loop. In systems using TDSF technology, the flow of hot gas controlled by a proportional valve is to be mixed with liquid refrigerant, partially expanded for cooling. While the proportional valve setting can be changed rapidly, imprecision and instability may be encountered because of delays in flow rate variations and system demands. The response times and amplitudes of changes have to be considered in system terms, which factors can be accounted for in accordance with the present invention.

The above referenced patent to Cowans et al, U.S. Pat. No. 7,178,353, also discloses a number of advantageous features within the system, which enhance the ability to separately control pressurized hot gas in one flow path and cold expanding refrigerant in another, before mixing. The patent consequently also discloses a number of techniques for interrupting or modifying flows to increase or decrease temperature particularly rapidly under specified conditions. However, there is often a need for assuring that temperature changes take place at controlled transitional rates that limit overshoot or otherwise provide assurance that a new target has been reached at the thermal load.

SUMMARY OF THE INVENTION

A TDSF system in accordance with the invention generally incorporates, as previously disclosed, separate flow paths for high temperature two-phase refrigerant and condensed, pressurized, partially expanded refrigerant at a lower temperature. Flow remainder in the high temperature path is controlled with a proportional valve and the temperature of the flow in the second path is controlled with a thermal expansion valve. A refrigerant mix of chosen pressure and temperature is thus provided for temperature control of a thermal load, the cycle being completed by recirculation of the two-phase refrigerant to the compressor. In accordance with the present invention, however, the rate of change of the hot gas flow as well as the final setting, are selectively varied by using access to stored control algorithms. This means that shifts of varying amounts from one flow rate to another can be effected stably, with due regard to system needs for response times varying the rate of change of the hot gas constituent. In one example, the proportioning valve is driven at a selectively variable frequency by a stepper motor that is responsive to the control algorithms. In a second example the control signals are varied in analog form, and an algorithm chosen signal amplitude controls the rate of change.

A further feature of this invention is the introduction of a flow control circuit including a fast acting control valve between the hot gas line subsequent to the proportioning valve and a return line to the compressor input, but before processor elements in that input line. When it is desired to cool the load virtually immediately, a valve in this bypass line, which may be a solenoid expansion valve, is opened to shunt all the hot gas flow back to the input of the compressor, so that only the cooling flow is applied to the load.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
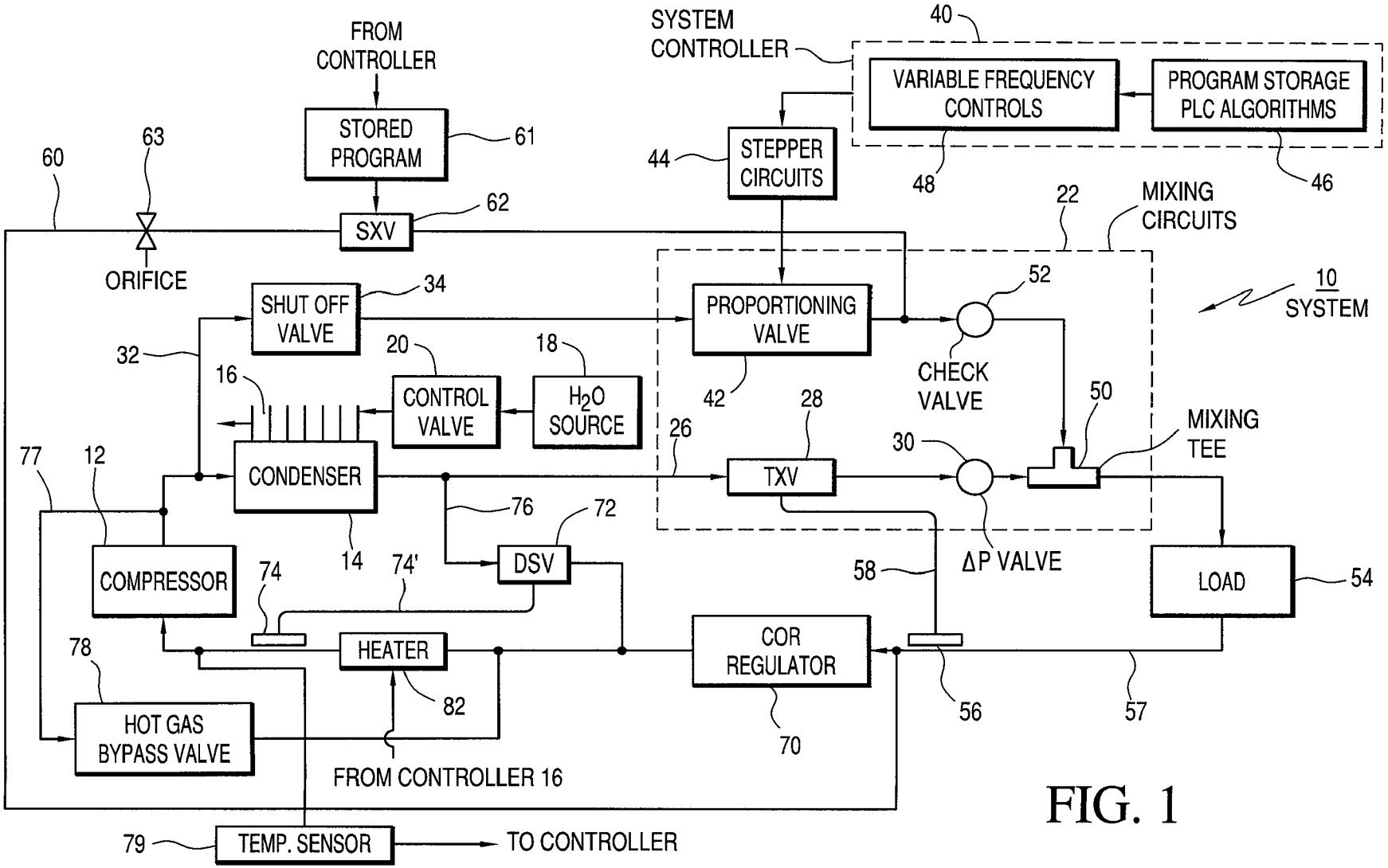
FIG. 1 is a block diagram of a TDSF system with flow rate control in accordance with the invention that uses a digital control scheme.

Referring now to FIG. 1, a TDSF system 10 includes, as described in the above-identified Cowans et al '353 patent, a refrigeration loop for a two-phase refrigerant which loop includes a compressor 12 feeding a first part of its pressurized output to a first high pressure gas path 32 and a second remaining part of its output 26 to a condenser 14. The condenser 14 is cooled with a flow of ambient temperature water from a facility 18. The water for cooling is fed to a heat exchanger 16 disposed in thermal contact relation to the condenser 14, the flow is further controllable by a control valve 20. Other fluid systems, or gas, may be used for cooling the condenser 14 to ambient temperature. The output from the condenser 14 is directed as one input to mixing circuits 22 that include a thermal expansion valve 28, hereafter TXV, for receiving and modulating the second flow. The output of the TXV 28 within the mixing circuits 22 is propagated through a pressure dropping ($\Delta P$) valve 30 for reasons previously expanded in the Cowans patent which need not be repeated here. The first flow path 32 from the output of the compressor 12 is directed first to a shut off valve 34, which feeds a separate input to the mixing circuits 22. However the first flow is modulated at a variable rate by a valve 42 whose setting in this example is controlled by a stepper control circuit 44 commanded by a system controller 40. The valve 42 is of the type known as a proportioning valve and provides a variable flow of pressurized hot gas to the mixing circuits 22. To change its setting, the controller 40 provides commands to the stepper control circuits 44 that generate a sequence of pulses supplied at a predetermined rate by a variable frequency control 48 to drive the proportioning valve 42 open or closed. In the controller system 40 stored programs 46 contain suitable control algorithms supplying any of a variety of integrating and/or differential functions, as described in the Antoniou and Christofferson patent entitled "Systems and Methods for Controlling Temperatures of Process Tools", U.S. Pat. No. 6,783,080. The chosen algorithm determines the rate at which the variable frequency control 48 feeds pulses to operate the proportioning valve 42. This actuation varies the response rate of the valve 42, consequently the mass of hot gas that is supplied in response.

The flows in the first flow path 26 and second flow path 32, after modulation are subsequently combined in a mixing tee 50 within the mixing circuits 22, after the hot gas flow has been passed through a check valve 52. The output from the mixing circuits 22 is then applied to the load 54, and its output is returned, via other circuits to the input to the compressor 12.

The TXV 28 is a well known device and is externally equalized by pressure communicated from a bulb 56 in operative relation (thermal interchange) with the return line 57 from the load 54. The bulb 56 generates a pressure level in the gas it contains that is applied via a coupling line 58 to the TXV 28, for equalization of the TXV setting to the load 54 output. The return line 57 from the load 54 passes serially through a Close-on-Rise (COR) regulator valve 70, toward the compressor 12 input. Before that input, however, it branches off at a shunt line 76 including a desuperheater valve (DSV) 72 of conventional purpose, that is externally equalized by pressure in a conduit 74' from a bulb 74 responsive the input temperature to the compressor 12. The shunt line 76 that includes the DSV 72 couples from the output of the condenser 14 to the return line 57 that leads to the compressor 12. A separate shunt line 77 couples the output of the compressor 12 back to the compressor input line 57, through a hot gas bypass valve (HGBV) 78 which responds to temperature levels at the compressor 12 input as detected by a temperature sensor 79 in that region of the shunt line 76. A temperature sensor 79 input is provided to the controller 40, which also provides a control output to a heater 82 in the compressor input line 57, the heater 82 serving to insure that the compressor 12 receives gaseous input only.

For purposes of rapid cooling, when operating independently of typical load temperature changes, the system 10 also includes a bypass line 60 starting at between the hot gas flow path after the proportioning valve 42 and extending to the return line 57 (the input to the compressor 12), the junction being made at a point prior to the input to the COR regulator valve 70. This bypass line 60 includes a solenoid expansion valve (SXV) 62, followed by an orifice 63 so that when the SXV 62 is abruptly closed no hot gas is supplied to the mixing circuit 22. The SXV 62 is controlled by the stored program circuits 61 responsive to the controller 40. The hot gas flow path 32 can also be closed by the shut off valve 34 before the proportioning valve 42.

Inasmuch as the general operation of the TDSF system is adequately described in U.S. Pat. No. 7,178,353, those portions which are not essential to the inventive features herein will only be briefly described. The flow of pressurized hot gas from the compressor 12 is fed into the hot gas pressurized flow line via the first flow path 32. The proportioning valve 42 is operated by the controller 40, usually in relation to any cooled expanded flow in the second flow path 26 so as to provide, from the mixing circuit 22, a predetermined output to the load 54 for the temperature and pressure conditions specified by the controller 40. Consequently, in the mixing circuits 22, the second flow in the second path 26 has been controllably expanded by the TXV 28 and applied to the separate input to the mixing tee 50 after passing the ΔP valve 30. Consequently, a combined flow at a predetermined pressure and temperature is available at the input to the load 54. Because the concept facilitates rapid pressure and temperature changes, and because the two-phase refrigerant is used directly in thermal exchange with the load 54, the system has unique operative capabilities and cost advantages.

Further uniqueness is now provided via the controller 40 in relation to the operation of the proportioning valve 42, and also the bypass line 60, in relation to the operation of the SXV 62. The controller 40 includes what may be called a variable frequency control board 48 that includes stored PLC algorithms to operate the stepper circuits 44 for control of the degree of opening of the proportioning valve 42. The hard wired stored programs supply the controller 40 with instructions for commanding the stepper circuits 44 to move the proportioning valve 42 open or closed at a selected rate to a desired final position.

Consequently, when a change in the setting of the proportioning valve 42 is indicated, as a new temperature level is chosen for the system 10, the controller 40 accesses the stored PLC algorithms in the storage 61 which indicate the rate of change as well as the limit position to be reached. The necessary number of stepper increments are supplied at a chosen rate, and the stepper control circuits 44 impulse the proportioning valve 42 accordingly. This consequently adapts the proportion and the rate of change of the hot gas flow to assure that the new setting is both precise and achieved with stability.

Figure 3:
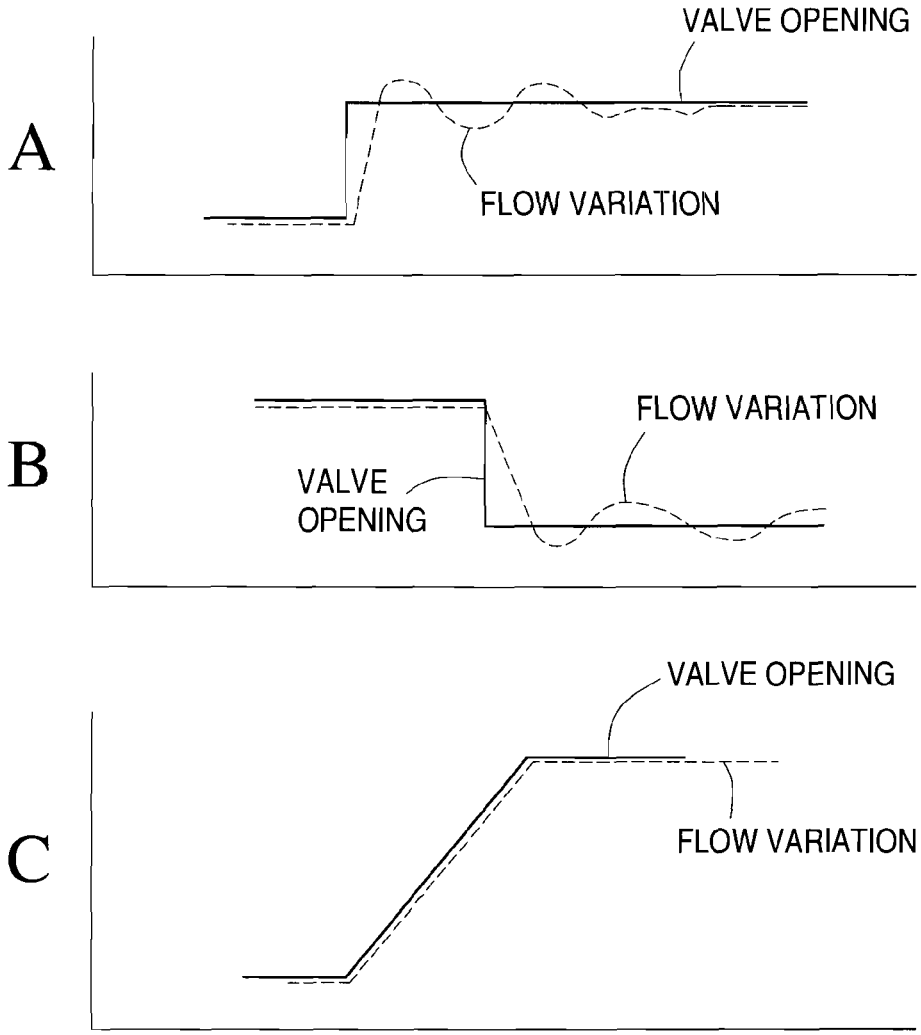

The advantages of this approach can perhaps better be appreciated by referring to the operative diagram of FIG. 3, illustrating in curve (A) sharp transition commands, as when changing from fully off to fully on. The dotted line curve shows the resulting flow changes, with delay in response on opening and overshoot on reaching target flow. This may be followed by oscillations about the target level. In waveform (B), illustrating by a solid line a sudden nominal change from full open to fully closed, a reciprocal instability condition occurs for a period of time as the valve is fully closed, as seen in the dotted line waveform which depicts typical actual flow conditions in response to sudden change. In contrast, in waveform (C) the incrementally changing slope of the valve change in opening (solid line) is very closely followed by the flow change (dotted line) and there is no overshoot. With the modulated stepper motor approach the angle of the slope can be varied arbitrarily.

There are some operating conditions in which it is desired or necessary to transition to a cooler temperature as quickly as possible, by passing the rate control. For this purpose, the SXV 62 in the bypass line 60 is driven by the PLC algorithm in the stored programs 61 to close virtually instantaneously, enabling the expanded coolant in the first flow line 26 to be operatively effective without delay. This bypass line 60, which includes an orifice 63, is coupled to the return line 57 which goes into the compressor 12 input, at a point prior to the COR regulator valve 70. Consequently, this feature provides a rapid response characteristic that supplements those features already mentioned in the aforementioned Cowans et al patent.

Figure 2:
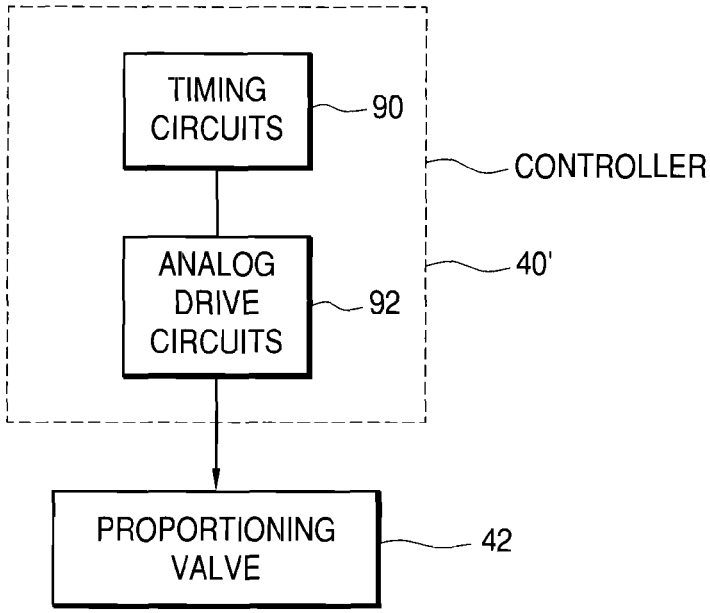
FIG. 2 is a block diagram of a part of a TDSF system that presents an alternative control scheme for use in the system of FIG. 1, and FIG. 3 comprises timing diagrams labeled A, B and C showing variations in response rates in systems in accordance with the invention.

In some systems it may be desired or necessary to use an analog system for changing the opening of the proportioning valve 42, and FIG. 2, to which reference is made, shows only the signal generating and motor driving parts of such a system, the remainder of the system of FIG. 1 being applicable and therefore not shown. Here the controller 40' provides a variable amplitude signal indicating a new target position for the proportioning valve 42, and selects one of a number of timing circuits 90 to supply a drive signal of the needed slope to actuate the analog drive circuit 92 which moves the proportioning valve 42. Again, a controlled rate of transition between the prior and new flow set points is achieved.

Although various forms and alternatives have been shown or described, utilizing the teachings of the invention, it should be appreciated that the invention is not limited thereto but encompasses all expedients and variations within the scope of the appended claims.

The invention claimed is:

1. A method of controlling temperature changes so as to minimize overshoot in the temperature of a thermal load in a process which uses a flow of compressed two-phase refrigerant divided variably into a mixture of pressurized hot gas of variable mass flow rate and a differential flow of expanded liquid/vapor mix, comprising the steps of:

determining a positive or negative differential between a new target temperature set point for the thermal load and an existing temperature set point at which the thermal load is being maintained;

accessing stored control algorithms to compute the rate of change to a new mass flow rate for the hot gas to be combined with the differential flow of expanded liquid/vapor mix so as to attain the desired revised temperature level for the thermal load;

incrementally varying the flow rate of the hot gas at a controlled transition rate dependent on the total span of change in temperature and in the positive or negative direction for the new mass flow rate needed to reach the target temperature, and maintaining the transition flow rate change in a range such that there is minimal overshoot in temperature of the thermal load when the desired target temperature is reached.

2. A method as set forth in claim 1 above, wherein the method further includes:

providing a substantially constant input flow of pressurized hot gas refrigerant;

dividing said input flow into a first flow that is controllable in mass flow rate and a second flow that represents the differential from the input flow;

varying the mass flow of the first flow in accordance with commands denoting the incremental changes in mass flow rate;

condensing the second flow to a substantially liquid state having a flow rate of the condensate depending on the variation of mass flow of the first flow;

thermally expanding the condensed second flow to provide a differentially varied second flow;

mixing the varied first flow with the differentially varied second flow to provide an input for thermal energy exchange; and passing the mixture of first and second flows in heat exchange relation to the thermal load, and until the thermal load temperature has reached the target temperature.

3. A system for controlling the temperature of a thermal load by direct transfer of thermal energy between a two-phase refrigerant and a thermal load to adjust the temperature thereof to a selected target level, the system comprising:

a compressor having an input receiving the two-phase refrigerant and providing a pressurized hot gas therefrom;

a first flow mechanism including a flow proportioning device responsive to control signals for providing a controllably selectable portion of the pressurized hot gas in a first flow path;

a controller system receiving command instructions as to changes to be introduced in the temperature of the thermal load, the controller system being configured to provide a sequence of incremental command impulses varying in the time domain to the flow proportioning device in the first path;

the sequence of command pulses for a desired change being proportional in rate and number to the amplitude of changes to be introduced in the temperature of the thermal load, such that overshoot when reaching the target temperature is minimized;

a second flow path coupled to the first flow path before the proportioning device, the second flow path including a condenser for converting the received portion of hot gas condensate flow, and further including a thermal expansion valve for expanding the received condensate flow to an at least partially vaporized state;

a flow junction receiving both the variable flow of hot gas in the first path and the at least partially vaporized flow in the second path, and providing the combined flow to the thermal load; and a return flow path for the combined flow coupled to the thermal load for providing the output from the thermal load to the input of the compressor.

4. A system as set forth in claim 3, wherein the system further includes a differential pressure device in the second flow path subsequent to the thermal expansion device to equalize pressure losses in the first and second flow paths, and wherein the system also includes refrigerant processing elements in the flow path between the thermal load output and the compressor input for restoring the refrigerant flow to a gaseous input phase for the compressor and wherein the system further includes a temperature equalization circuit between the output from the thermal load and the thermal expansion valve.

* * * * *